US007931417B2

(12) United States Patent
Yamamoto et al.

(10) Patent No.: US 7,931,417 B2
(45) Date of Patent: Apr. 26, 2011

(54) STAMP MARKER

(75) Inventors: Hiroyoshi Yamamoto, Kobe (JP); Shigeto Taguchi, Amagasaki (JP); Atushi Sudo, Hirakata (JP)

(73) Assignee: Sakura Color Products Corporation (JP)

( * ) Notice: Subject to any disclaimer, the term of this patent is extended or adjusted under 35 U.S.C. 154(b) by 0 days.

(21) Appl. No.: 12/584,533

(22) Filed: Sep. 8, 2009

(65) Prior Publication Data

US 2010/0021228 A1 Jan. 28, 2010

Related U.S. Application Data

(63) Continuation of application No. PCT/JP2008/055647, filed on Mar. 26, 2008.

(30) Foreign Application Priority Data

Mar. 30, 2007 (JP) ..... 2007-093777

(51) Int. Cl.
*B43K 5/00* (2006.01)

(52) U.S. Cl. ..... 401/206; 401/205; 401/198

(58) Field of Classification Search ..... 401/198, 401/261–266, 199, 205, 206
See application file for complete search history.

(56) References Cited

U.S. PATENT DOCUMENTS

| | | | | | |
|---|---|---|---|---|---|
| 1,413,827 | A * | 4/1922 | Briggs | ..... | 401/205 |
| 3,016,561 | A * | 1/1962 | Hulsh | ..... | 401/262 |
| 4,923,317 | A * | 5/1990 | Bishop et al. | ..... | 401/205 |
| 5,082,386 | A * | 1/1992 | Hironaka et al. | ..... | 401/206 |
| 5,411,345 | A * | 5/1995 | Ueji et al. | ..... | 401/206 |
| 5,820,285 | A * | 10/1998 | Ikeda et al. | ..... | 401/199 |
| 6,039,486 | A * | 3/2000 | Breslin | ..... | 401/88 |
| 6,280,109 | B1 * | 8/2001 | Serratore | ..... | 401/11 |
| 6,582,142 | B2 * | 6/2003 | Keller et al. | ..... | 401/11 |
| 6,883,996 | B2 * | 4/2005 | Ishida | ..... | 401/206 |
| 7,320,553 | B1 * | 1/2008 | Nunez | ..... | 401/198 |

FOREIGN PATENT DOCUMENTS

| | | |
|---|---|---|
| JP | 36-20513 | 10/1961 |
| JP | 50-155323 | 12/1975 |
| JP | 08-108607 | 4/1996 |
| JP | 2001-080264 | 3/2001 |
| JP | 2006-150899 | 6/2006 |
| JP | 2008-062522 | 3/2008 |

* cited by examiner

*Primary Examiner* — David J Walczak
(74) *Attorney, Agent, or Firm* — Wood, Phillips, Katz, Clark & Mortimer

(57) ABSTRACT

A stamp marker capable of adhering an application liquid to a target. The stamp marker includes a liquid-permeating member and a container containing an application liquid, the liquid-permeating member including a distal member, a base, and a fixing member. The distal member has a surface having a contacting part and a noncontacting part, the contacting part having a shape, so as to copy the shape onto the target by bringing the surface of the distal member into contact with the target to make the liquid adhere to the target, so that an adhesion mark of a predetermined shape is formed on the target.

18 Claims, 5 Drawing Sheets

STAMP MARKER

BACKGROUND OF THE INVENTION

1. Field of the Invention

The present invention relates to a stamp marker capable of forming an adhesion mark having a predetermined shape on a target by bringing a part of the marker, the part having liquid such as ink, into contact with the target so as to adhere the liquid to the target.

2. Background Art

Conventionally, some kinds of markers each containing an application liquid in a container so as to apply the liquid by means of an application part formed by such as felt or a fiber bundle tip have been used. Such kinds of markers are designed to apply an application liquid onto a target to be applied, so as to display letters or shapes using adhesion trace.

Such a target includes various things such as paper or articles. The patent document 1 specified below discloses such an applicator as described above, which includes a liquid filling part, an application part, and a valve interposed between the both parts.

Patent document 1: JP 2001-80264A

SUMMARY OF THE INVENTION

Problem to be Solved by the Invention

Nondestructive inspections are executed on piping or the like used for nuclear facilities. On such inspections, such kinds of markers are used to mark locations to be inspected so as to prevent displacement of the locations and to display the locations definitely. However, freehand drawing of a mark such as a circle involves effort and/or causes deviations in locations.

There is also another way to be marked using a self-inking stamp. However, such the way is unsuited for use in the above-mentioned purpose because of its unapparent marking. Further, in the case of marking on a nonplanar face, a means for reliable marking is required.

Therefore, the present invention proposed herein is to provide a stamp marker capable of accurately forming an adhesion mark on a target with an application liquid made adhered to the target.

Means to Solve the Problem

An aspect of the present invention proposed for achieving the aim described above is a stamp marker for forming a mark on a target, the stamp marker including a liquid-permeating member made of a porous material and having a surface and a container containing an application liquid and for supplying the liquid to the surface of the liquid-permeating member, the surface having a contacting part contactable with the target and a noncontacting part other than the contacting part, the contacting part having a shape, so as to copy the shape onto the target by bringing the liquid-permeating member into contact with the target to make the liquid adhere to the target, so that an adhesion mark of a predetermined shape is formed on the target.

In one form, the stamp marker is designed to supply the application liquid contained in the container to the liquid-permeating member made of a porous material and make the liquid adhere to a target so as to copy the shape onto the target by bringing the liquid-permeating member into contact with the target, so that an adhesion mark of a predetermined shape is formed on the target. That facilitates marking to a required position.

In one form, the surface of the liquid-permeating member is shaped by pressing a tool onto the surface, the tool having a shape corresponding to at least a part of the noncontacting part. That facilitates formation of the noncontacting part.

In one form, the liquid-permeating member is made of felt, so that both permeability of the liquid and strength of the member may be achieved.

It is possible to employ the liquid-permeating member including a distal member and a base so as to supply the liquid through the base to the distal member, the distal member having a surface that has a contacting part and a noncontacting part.

In one form, the distal member and the base are fixed to each other by means of the fixing member at least extending from the inside of the distal member to the inside of the base. This may facilitate fixation of the distal member and the base.

In one form, the fixing member penetrates from the noncontacting part through the distal member into the base. Formation of an adhesion mark such as marking is enabled without obstructing the contacting part. Further, the fixing member may be easily detached, whereby the distal member may be easily attachable and detachable.

In one form, a screw is used as the fixing member, thereby facilitating attaching and detaching the fixing member.

In one form, the distal member and the base are made of felt, and the fixing member is screwed from the distal member so as to fix the distal member and the base to each other. Through this arrangement, the fixing member may be easily attached and detached.

The stamp marker may further include a liquid regulator for regulating supply of the liquid, so that the liquid is supplied to the liquid-permeating member via the regulator. That prevents the liquid from being supplied in an amount more than required.

In one form, the liquid is substantially white, thereby being easily viewable in formation of an adhesion mark onto a dark target.

Advantageous Effect of the Invention

The stamp marker in the present invention ensures a reliable adhesion of an application liquid onto a target and an easy work.

BRIEF DESCRIPTION OF THE DRAWINGS

FIG. 1A is a perspective view thereof, and FIG. 1B is an exploded perspective view thereof other than a cap;

FIG. 2A is a front view of the stamp marker, and FIG. 2B is a cross section taken along a line A-A in FIG. 2A;

DESCRIPTION OF PREFERRED EMBODIMENTS

Figure 1A:
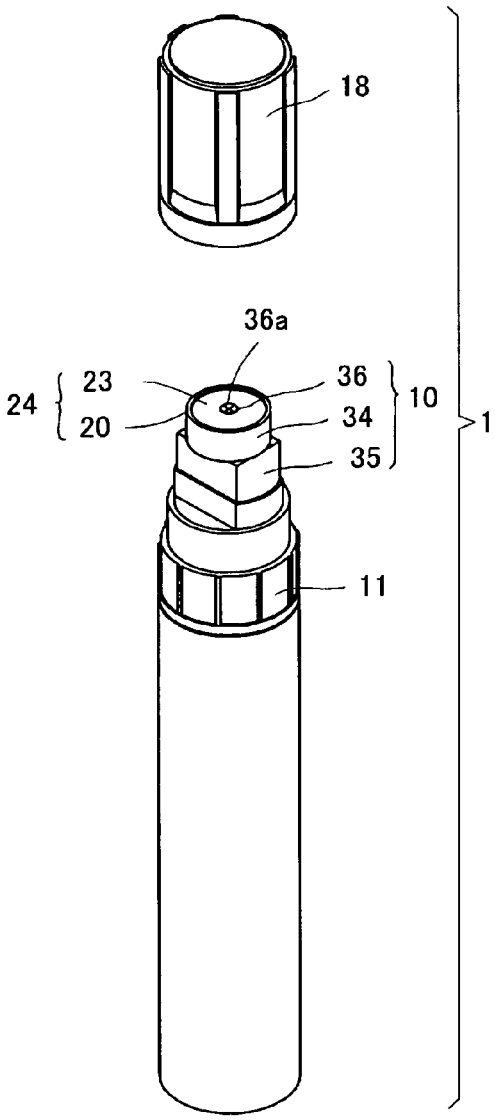
FIGS. 1A and 1B are views of a stamp marker relating to a first embodiment of the present invention.

Now, a preferred embodiment of the present invention will be described in detail below, making reference to the accompanying drawings. A stamp marker 1 in a first embodiment of the present invention, as shown in FIGS. 1A to 2B, mainly consists of a liquid-permeating member 10, a closing member 11, a liquid regulator 13, and a container 15. An application liquid contained in the container 15 is supplied to a contacting part 20 formed on the liquid-permeating member 10, so as to be adhered to a target with the contacting part 20 pressed onto the target. The liquid-permeating member has distal and proximal ends spaced axially from each other.

Figure 1B:
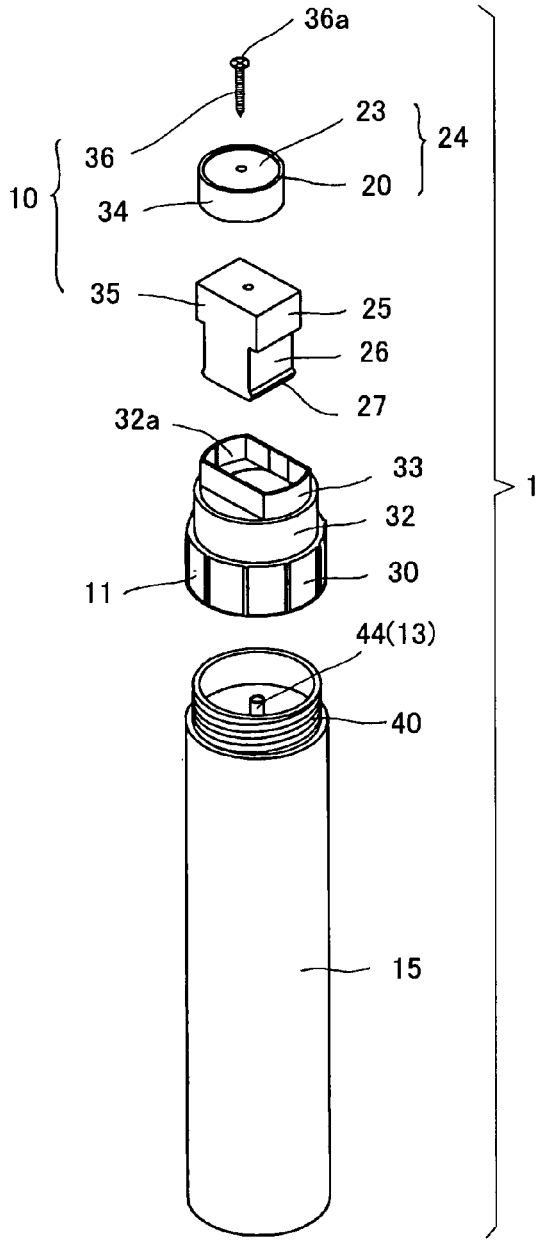
Figure 2A:
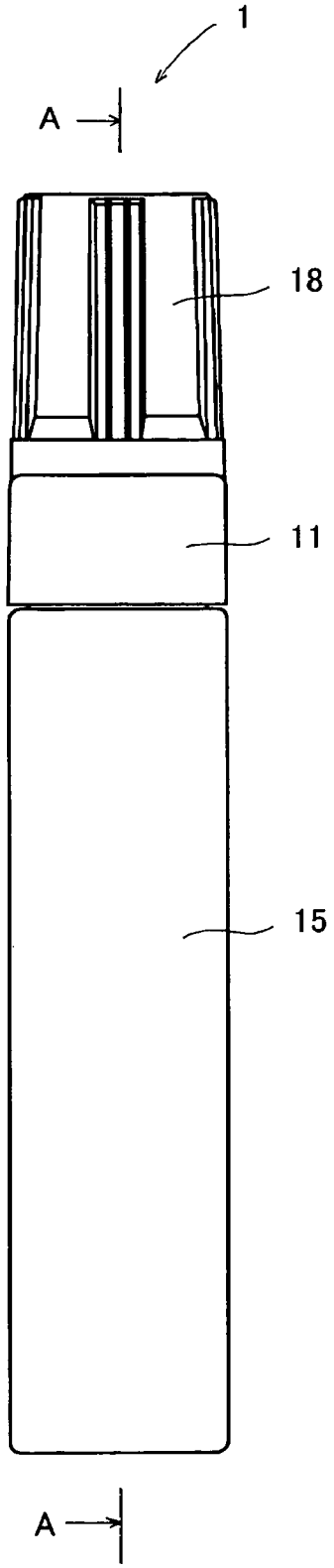
FIGS. 2A and 2B are views of the stamp marker shown in FIG. 1A.
Figure 2B:
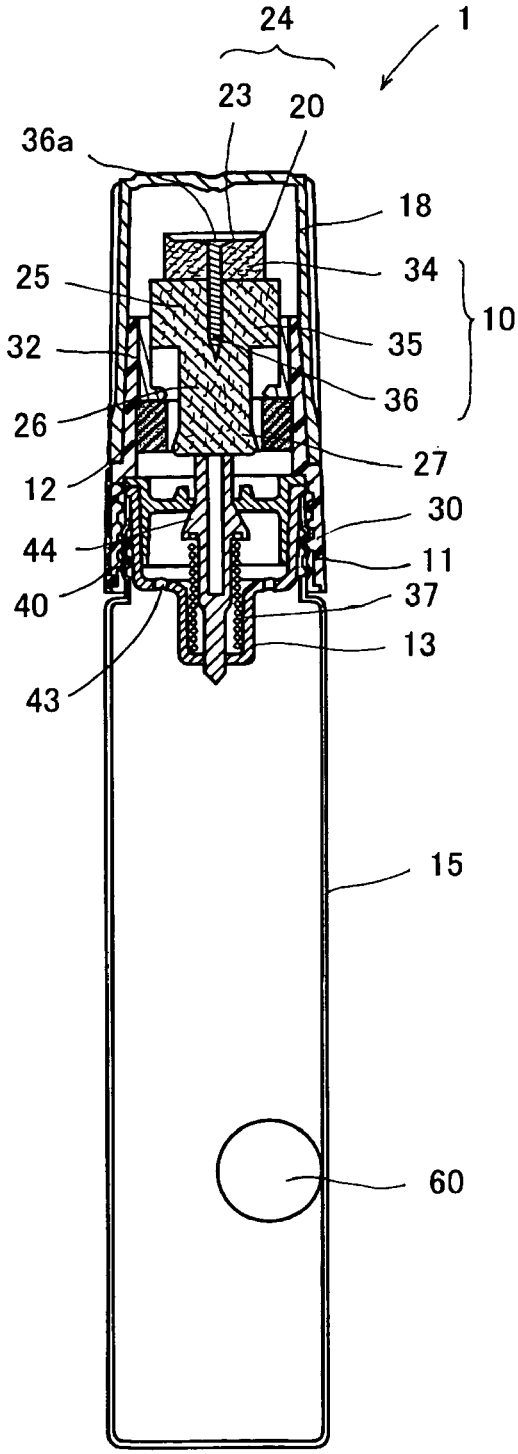

Referring to FIGS. 1B and 2B, the liquid-permeating member 10 includes a distal member 34, a base 35, and a fixing member 36. The distal member 34 and the base 35 are made of felt, which is a porous material allowing passage of an application liquid in and out.

The distal member 34 has a surface 24 having a contacting part 20 and a noncontacting part 23. The contacting part 20 is protruding axially more than the noncontacting part 23, whereas the noncontacting part 23 is depressed axially more than the contacting part 20. The contacting part 20 of the surface 24 is shown to be substantially planar.

By contact of the surface 24 of the distal member 34 with a target, the contacting part 20 is brought into contact with the target without making the depressed noncontacting part 23 contact with the target. That allows the liquid to adhere to the target so as to copy a shape of the contacting part 20. As a consequence, an adhesion mark of a predetermined shape is formed on the target.

The distal member 34 in the present embodiment has a cylindrical or columnar shape in whole. The contacting part 20 is on a rim of the surface 24 of the distal member 34. Thus, the adhesion mark on the target formed by using the stamp marker 1 in the present embodiment is of a circle.

The base 35, as shown in FIGS. 1B and 2B, is a T-shaped member with a wide part 25 and a prismatic part 26. The prismatic part 26 has a retaining projection 27. On attachment of the base 35 to the closing member 11, the projection 27 is caught by the closing member 11, thereby keeping the base 35 from disengaging from the closing member 11.

The distal member 34 and the base 35 contacts with each other, so that the liquid in the container 15 is supplied to the distal member 34 through the base 35.

In the present embodiment, the distal member 34 and the base 35 are made of the same kind of felt. Herein, materials thereof are not particularly limited only if the material allows the liquid to permeate in and out, that is, a porous material. Alternatively, different kinds of felt may be used for the distal member 34 and the base 35, or a material other than felt such as sponge of interconnected cell may be used.

The distal member 34 and the base 35 are made into a predetermined shape by actions such as cutting. The surface 24 of the distal member 34 can be shaped by means of a tool 80 described below.

Figure 11:
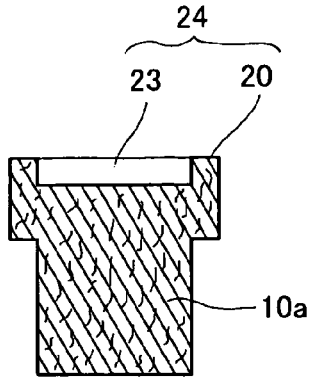
FIG. 11 is cross section showing a yet further modified embodiment of a liquid-permeating member.

As shown in FIG. 11, a liquid-permeating member 10*a* may be one unitary piece uniting a distal member 34 and a base 35, not separate members.

Generally, fibers making up felt are hardly oriented in a thickness direction and most likely oriented in a direction other than a thickness direction. Therefore, even if the same felt is used, arrangement of the felt in different directions changes a character of the distal member 34 and the base 35. Though the same felt is used for the distal member 34 and the base 35 in this embodiment, the felt of the distal member 34 is arranged in a direction different from that of the base 35, so as to ensure balances of permeability of an application liquid and fiber strength as described below.

More specifically, since felt is generally produced by entangling fibers in a predetermined manner, few fibers are oriented in a thickness direction and most fibers are likely to be oriented in a longitudinal or width direction. Higher permeability of a liquid (liquid permeability) is generally performed in a direction along fibers. Therefore, in using as the liquid-permeating member 10, it is better to permeate the liquid in a fiber direction, that is, a direction (longitudinal or width direction) other than a thickness direction. On the other hand, in the case that bending and/or pull force acts on the liquid-permeating member 10, higher strength is performed by such an arrangement that the force acts in a direction along fibers. Therefore, bending or pulling of felt in the other direction (longitudinal or width direction) increases in strength.

In the liquid-permeating member 10 in this embodiment, the distal member 34 is arranged such that a thickness direction of felt is oriented in an axial direction of the stamp marker 1 and the base 35 is arranged such that a direction other than a thickness direction of felt is oriented in the axial direction thereof.

As to permeability of the liquid, the base 35 allows successful supply of the liquid between the regulator 13 and the distal member 34, whereas the distal member 34 allows crosswise permeation of the liquid so as to readily distribute the liquid throughout the surface 24. Even when the distal member 34 is sometimes subjected to a curving force in the use of the marker 1, it is also possible to have an increased strength.

The distal member 34 and the base 35 each are produced by cutting felt having a substantially constant thickness. The distal member 34 is formed into a cylindrical or columnar shape by punching out the felt in a circle, so as to have a thickness direction of the felt oriented in an axial direction of the stamp marker 1. The base 35 is formed by punching out the felt in a T shape, so as to have a direction other than a thickness direction oriented in the axial direction of the marker 1.

In order to enlarge a size of the adhesion mark, it is necessary to enlarge the contacting part 20 of the surface 24 of the distal member 34, the member 34 being also enlarged. In the case of a normal felt-tip pen in which the distal member 34 and the base 35 are composed of one unitary piece, not composed of separate members, it is necessary to use thick and long felt. However, since being made separately, the distal member 34 and the base 35 avoids the need to do so and are easily made even if having complicated shapes.

The use of the large distal member 34 achieves formation of a large adhesion mark even if the small container 15 or the small base 35 are used.

Figure 3:
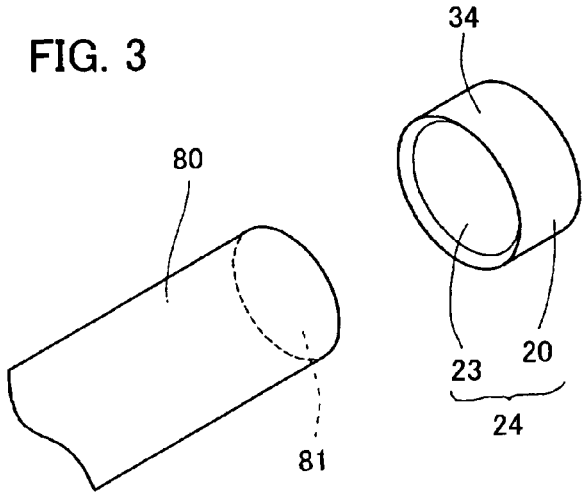
FIG. 3 is a perspective view of a distal member and a shaping tool.

Referring to FIG. 3, the surface 24 of the distal member 34 is shaped by a tool (shaping tool) 80. The tool 80 has a tip 81, which has a shape corresponding to the entire shape of the noncontacting part 23. Specifically, the tip 81 is of a circle having an outer diameter slightly smaller than an outer diameter of the distal member 34. The tool 80 has a cylindrical or columnar shape.

The tool 80 is heated, and then the tip 81 of the tool 80 is pressed onto the surface 24 of the distal member 34. The tool 80 is heated at such a heating temperature that felt, which is a material of the distal member 34, can be easily deformed, and at an appropriate temperature depending on materials. The pressing force or time is determined under the proper conditions for shaping.

In the present embodiment, felt, especially felt made of polyester, is used as the distal member 34. The felt is pressed for 5 seconds by a force of 1900 N and at a temperature of 150 degrees centigrade.

A pressed portion (noncontacting part 23) has an area of 1.3 square centimeters.

Upon pressing of the tip 81 of the heated tool 80 onto the surface 24 of the distal member 34, the pressed portion is compressed to be depressed. Thereby, another unpressed portion becomes protruding more than the pressed portion. The depressed portion becomes the noncontacting part 23 and the other portion becomes the contacting part 20 that at least partially surrounds the noncontacting part.

In this way, the surface 24 of the distal member 34 is easily shaped. The noncontacting part 23 in this embodiment is formed in a circular shape, but may be formed in other shapes, even in a complicated shape, only by changing the shape of the tool 80.

According to the above-mentioned shaping method, the entire portion of the noncontacting part 23 is formed by pressing of the tool 80, but it is possible to shape only a portion of the noncontacting part 23 by the tool 80 and the rest thereof by another method.

The felt of the noncontacting part 23 pressed by the tool 80 has lower permeability, resulting from a higher fiber density than the other portion and/or a melting as a consequence of compression. Thus, the liquid supplied to the distal member 34 is supplied more easily to the contacting part 20 unpressed by the tool 80 than to the noncontacting part 23. That forms clear adhesion mark in use.

The distal member 34 and the base 35 are united by the fixing member 36 with held in abutting contact.

The fixing member 36 is a stick-like member, which penetrates through an inside of the distal member 34 to an inside of the base 35. The fixing member 36 is a screw, as shown in FIG. 2B, penetrating from the noncontacting part 23 of the surface 24 of the distal member 34 through the inside of the distal member 34 into a middle portion of the base 35.

The screw used as the fixing member 36 is a wood screw, having a head 36*a* with an end face screwed in so as to be substantially flush with the noncontacting part 23. Thus, when the distal member 34 is fixed by the fixing member 36, the head 36*a* is nearer container 15 than an edge of the contacting part 20, so as to be out of contact with a target and keep out of the way in the use of the stamp marker 1.

A pilot hole can be drilled on the distal member 34 and the base 35 so as to screw in the hole for uniting the distal member 34 and the base 35 by the fixing member 36, but the fixing member 36 may be screwed without drilling the pilot hole for fixing because felt is used for the distal member 34 and the base 35 in this embodiment.

The liquid-permeating member 10 united in this way is arranged such that the surface 24 of the distal member 34 comes to a distal end.

The fixing member 36 is easily attached and detached because being a wood screw. Thus, another distal member 34 having a different contacting member 20 can be attached after detaching the fixing member 36, thereby easily forming a different adhesion mark on a target.

Herein, the fixing member 36 in this embodiment is a wood screw, but may be others as described below. A member such as a screw other than a wood screw, a pin, and a nail, for example, may be used to fix by penetrating through the inside of the distal member 34 to the base 35.

The shape of the contacting part 20 of the marker 1 determines a shape of an adhesion mark formed on a target in use. Thus, the contacting part 20 has a predetermined size, a shape, or a width corresponding to a predetermined shape of a required adhesion mark. In this embodiment, it is of a circle, but may be of a polygonal shape such as a triangle or a square surrounding a certain area, a shape of star linking edges, a shape lacking a part of its contour such as a C shape, or a cross mark without surrounding a certain area.

The liquid-permeating member 10 is guided by a guide 33 located at the distal end of a small diameter part 32 of the closing member 11, being held movably in a longitudinal direction. Further, the liquid-permeating member 10 is urged toward the distal end by a spring 37, so as to be normally situated nearer the distal end within a movable range and at the position where the retaining projection 27 is caught by the closing member 11. In the use of the stamp marker 1, by bringing the contacting part 20 into contact with a target with holding the container 15, the liquid-permeating member 10 is moved backward, so as to supply an application liquid.

The closing member 11, as shown in FIGS. 1B and 2B, has a large diameter part 30 and the small diameter part 32. The large diameter part 30 has an internal thread, which is engaged with an external thread 40 of the container 15, so that the closing member 11 is fastened to the container 15.

The small diameter part 32 has an outer diameter smaller than that of the large diameter part 30 and is located nearer the distal end. As shown in FIG. 2B, a cap 18 seals the small diameter part 32 by bringing an inside of the cap 18 into close contact with an outer periphery of the small diameter part 32, thereby preventing exposure of the liquid-permeating member 10.

Further, the small diameter part 32 has at its distal end an opening 32*a*, into which the liquid-permeating member 10 is inserted. The liquid-permeating member 10 is partly exposed from the opening 32.

The closing member 11 is made by a material such as resin molding, but is not particularly limited thereto and may be made by another material.

There is provided a ring 12 being a circular ring and for temporarily storing an application liquid.

The ring 12 in this embodiment is made of polyurethane sponge.

The regulator 13 is directed to regulate supply of an application liquid and located adjacent to an opening of the container 15. The container 15 is covered with the regulator 13, through which an application liquid in the container 15 is supplied to the liquid-permeating member 10.

The regulator 13 has an opening 43 and a valve 44 being in communication with the opening 43. Upon opening of the valve 44, an application liquid in the container 15 passes through the opening 43 and the valve 44, so as to be supplied to the liquid-permeating member 10.

Opening and closing of the valve 44 is done by movement of the liquid-permeating member 10. The member 10 is normally situated at a position nearer the distal end within the movable range so as to close the valve 44, whereby the liquid is not supplied. Pressing of the contacting part 20 onto a target makes the liquid-permeating member move backward, thereby opening the valve 44. That allows supply of the liquid.

In this way, the stamp marker 1 in this embodiment has the regulator 13 for regulating supply of the liquid, thereby supplying the liquid when necessary. Therefore, it is possible to apply a great deal of the liquid when in use and to prevent the liquid from being supplied needlessly when not in use.

The container 15 is a based receptacle of an elongated hollow cylindrical shape with an opening at one end. The outer thread 40 is formed around an outer periphery of an edge adjacent to the opening, thereby fastening the closing member 11 to the container 15.

The container 15 in this embodiment is made of metal, but may be made of another material such as resin.

The container 15 has an inner space for containing an application liquid.

An application liquid contained in the container 15 may be any kind of liquid according to a target or a purpose. The known ink may be used. Color of the liquid is not also particularly limited, but substantially white ink can be used for marking in nuclear facilities. In this case, adhesion of the liquid facilitates visualization of a display.

The container 15 further has an agitating ball 60 in the inner space for agitating the liquid uniformly by shaking the stamp marker 1.

The agitating ball 60 is made of a material not particularly limited, but a glass ball is used in this embodiment.

The stamp marker 1 is assembled in such a manner that the liquid-permeating member 10 and the ring 12 are inserted through the large diameter part 30 into the closing member 11, which is then fastened to the container 15 containing an application liquid and the agitating ball 60 and being arranged with the regulator 13.

Then, as shown in FIGS. 1A to 2B, the whole members are united such that the surface 24 of the distal member 34 of the liquid-permeating member 10 is exposed from the opening 32*a* of the small diameter part 32 of the closing member 11.

In the stamp marker 1 immediately after assembly, the liquid is not absorbed in the liquid-permeating member 10. When the surface 24 of the distal member 34 of the member 10 is pressed onto a target with the surface 24 down, a proximal end of the member 10 opens the valve 44 of the regulator 13, through which the liquid contained in the container 15 is supplied to the member 10. The liquid moves to the contacting part 20, so as to be ready for stamping.

The surface 24 of the distal member 34 of the liquid-permeating member 10 is pressed onto a spot in the target to be marked by the liquid. The contacting part 20 is brought into contact with the target, so that a shape according to the contacting part 20 is copied to form an adhesion mark on the target. In this embodiment, the contacting part 20 has a circular shape, thereby forming a circular adhesion mark on the target.

The valve 45 is closed by a forward movement of the liquid-permeating member 10 when the liquid is not to be supplied, thereby preventing an unnecessary liquid from being supplied when not necessary.

If the contacting part 24 and its vicinity were left open in no use of the stamp marker 1, the liquid might be dry therearound or the contacting part 24 might be touched to and contaminate somewhere. In order to prevent such an undesirous case, the cap 18 attached to the closing member 11 covers over around the liquid-permeating member 10 so as to seal it.

The liquid-permeating member 10 described above mainly consists of the distal member 34 and the base 35 fixed to each other in close contact by the fixing member 36 that is a wood screw. However, such a liquid-permeating member 50, 51, 52, 53, 54, 55, or 56 as shown in FIGS. 4 to 10 each having a configuration other than the liquid-permeating member 10 may be employed.

Herein, the liquid-permeating members 50, 51, 52, 53, 54, 55, and 56 each are composed of the same distal member 34 and the same base 35 as those of the liquid-permeating member 10.

Figure 4:
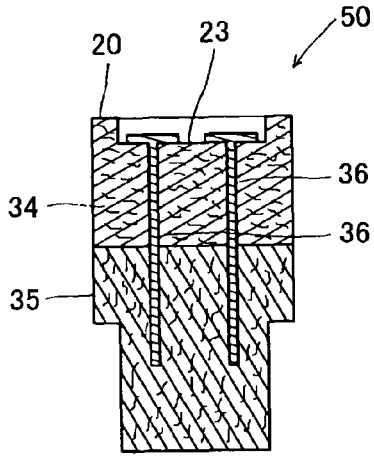
FIG. 4 is a cross section showing a modified embodiment of a liquid-permeating member.

The liquid-permeating member 50 shown in FIG. 4 uses two of the same fixing members 36 as that used in the above-mentioned member 10, which are screwed in the member 50 from the noncontacting part 23.

Figure 5:
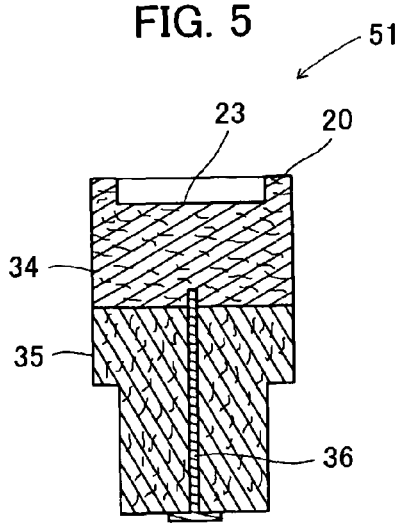
FIG. 5 is a cross section showing another modified embodiment of a liquid-permeating member.

The liquid-permeating member 51 shown in FIG. 5 uses the same fixing member 36 as that used in the above-mentioned member 10, which is screwed in the member 51 from the base 35.

Figure 6:
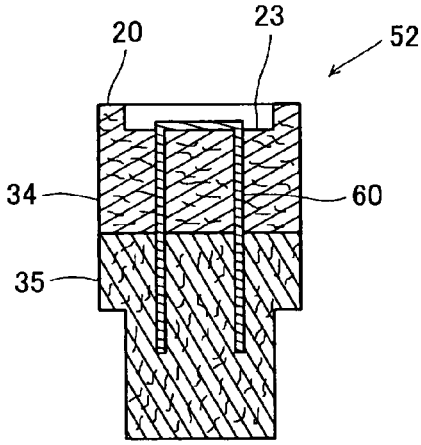
FIG. 6 is a cross section showing a still another modified embodiment of a liquid-permeating member.

The liquid-permeating member 52 shown in FIG. 6 uses a fixing member 60 that is a U-shaped pin, which is screwed in the member 52 from the noncontacting part 23. A staple can be used as the fixing member 60.

Figure 7:
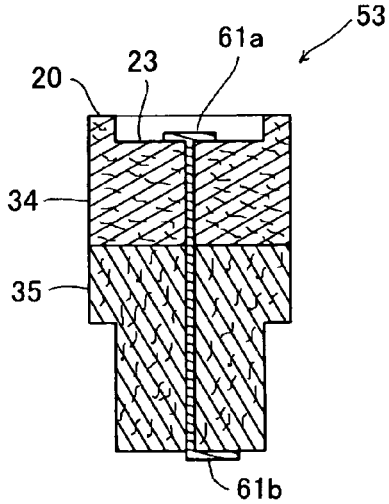
FIG. 7 is a cross section showing a yet another modified embodiment of a liquid-permeating member.

The liquid-permeating member 53 shown in FIG. 7 uses a fixing member 61 that is a pin with a head 61*a* at one end, the member 61 penetrating through the distal member 34 and the base 35 for fixing. The head 61*a* is located on the noncontacting part 23. The other end, which is remote from the head 61*a* is bent, forming a bent portion 61*b*.

Figure 8:
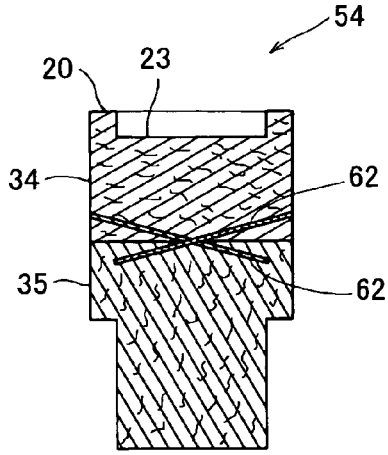
FIG. 8 is a cross section showing a yet still another modified embodiment of a liquid-permeating member.

The liquid-permeating member 54 shown in FIG. 8 uses fixing members 62 that are pins, which are screwed in the base 35 from the sides of the distal member 34.

Figure 9:
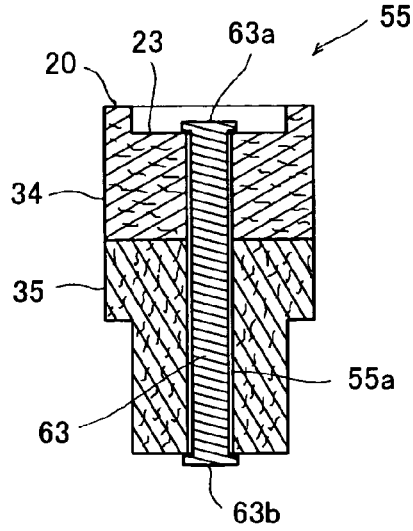
FIG. 9 is a cross section showing a further modified embodiment of a liquid-permeating member.

The liquid-permeating member 55 shown in FIG. 9 uses a fixing member 63, which is inserted into a throughhole 55*a* extending through the distal member 34 and the base 35. Both ends of the fixing member 63 are provided with heads 63*a* and 63*b* respectively.

A bolt and a nut may be used as the fixing member 63 with a head of the bolt and the nut serving as the heads 63*a* and 63*b* respectively. Alternatively, a resin stick may be used as the member 63 with at least one of ends melted after insertion so as to make the heads 63*a* and/or 63*b*.

Figure 10:
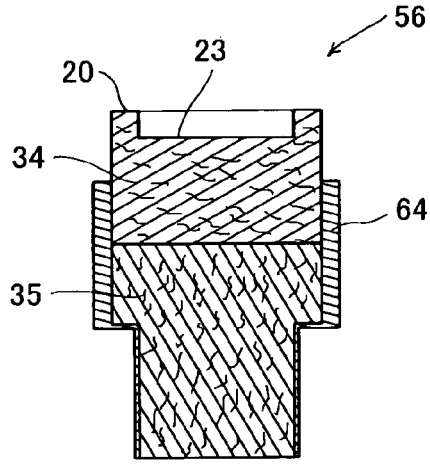
FIG. 10 is a cross section showing a still further modified embodiment of a liquid-permeating member.

The liquid-permeating member 56 shown in FIG. 10 uses a fixing member 64. The distal member 34 and the base 35 are fitted inside the fixing member 64 so as to be fixed. The fixing member 64 has such a shape as covering sides of the distal member 34 and the base 35, but not covering the surface of the distal member 34 including the contacting part 20 and the noncontacting part 23 and a proximal end of the base 35.

The liquid-permeating members 50, 52, and 54 respectively shown in FIGS. 4, 6, and 8 are each fixed at two locations by the fixing members 36, 60, 62, so that the distal member 34 and the base 35 are less likely to cause relative rotation even with a rotational force occurred therebetween.

In this way, the stamp marker 1 in this embodiment makes an application liquid adhere to the target by bringing the contacting part 20 of the liquid-permeating member 10 onto a target, thereby forming an adhesion mark of a predetermined shape on the target. That facilitates marking at a destination point. Further, the stamp marker 1 in this embodiment is less likely to cause relative displacement in forming an adhesion mark, thereby accurately marking a position to be inspected of members such as piping used in nuclear facilities, and further facilitating working.

The stamp marker 1 described above may be also used as a normal pen. With the contacting part 20 moved while being pressed, an application liquid is adhered to its moving track.

The invention claimed is:

1. A stamp marker for forming a mark on a target, the stamp marker comprising:

a liquid-permeating member made of a porous material and having a surface, the liquid-permeating member having proximal and distal ends spaced axially from each other; and a container containing an application liquid and for supplying the liquid to the surface of the liquid-permeating member, the surface having a contacting part contactable with the target and a noncontacting part other than the contacting part, the contacting part having a shape, so as to copy the shape onto the target by bringing the liquid-permeating member into contact with the target to make the liquid adhere to the target, so that an adhesion mark of a predetermined required shape is formed on the target, the contacting part protruding axially away from the proximal end of the liquid-permeating member more than the noncontacting part protrudes axially away from the proximal end of the liquid-permeating member, the contacting and noncontacting parts facing in substantially the same direction, wherein the liquid-permeating member comprises a distal member and a base so as to supply the liquid through the base to the distal member, the distal member having a surface that has the contacting part and the noncontacting part, the distal member and the base being fixed to each other by means of a fixing member at least extending from an inside of the distal member to an inside of the base.

2. The stamp marker as defined in claim 1, the fixing member penetrating from the noncontacting part through the distal member into the base.

3. The stamp marker as defined in claim 2, the fixing member being composed of a screw.

4. The stamp marker as defined in claim 2, the distal member and the base being made of felt, and the fixing member being screwed from the distal member so as to fix the distal member and the base to each other.

5. A stamp marker for forming a target, the stamp marker comprising:

a liquid-permeating member made of a porous material and having a surface, the liquid-permeating member having proximal and distal ends spaced axially from each other; and a container containing an application liquid and for supplying the liquid to the surface of the liquid-permeating member, the surface having a contacting part contactable with the target and a noncontacting part other than the contacting part, the contacting part having a shape, so as to copy the shape onto the target by bringing the liquid-permeating member into contact with the target to make the liquid adhere to the target, so that an adhesion mark of a predetermined required shape is formed on the target, the contacting part protruding axially away from the proximal end of the liquid-permeating member more than the noncontactinq part protrudes axially away from the proximal end of the liquid-permeating member, the contacting and noncontacting parts facing in substantially the same direction, wherein the liquid-permeating member comprises a distal member and a base so as to supply the liquid through the base to the distal member, the distal member having a surface that has the contacting part and the noncontactinq part, wherein the distal member and base are made from separate felt pieces each having a fiber pattern and the felt pieces of the base and distal member are arranged so that the fiber patterns are in different directions.

6. A stamp marker for forming a mark on a target, the stamp marker comprising:

a liquid-permeating member made of a porous material and having a surface, the liquid-permeating member having proximal and distal ends spaced axially from each other; and a container containing an application liquid and for supplying the liquid to the surface of the liquid-permeating member, the surface having a contacting part contactable with the target and a noncontacting part other than the contacting part, the contacting part having a shape, so as to copy the shape onto the target by bringing the liquid-permeating member into contact with the target to make the liquid adhere to the target, so that an adhesion mark of a predetermined required shape is formed on the target, the contacting part protruding axially away from the proximal end of the liquid-permeating member more than the noncontactinq part protrudes axially away from the proximal end of the liquid-permeating member, the contacting and noncontactinq parts facing in substantially the same direction, wherein the noncontacting part and contacting part are each made from a material and the material of the noncontacting part is denser than the material of the contacting part.

7. The stamp marker as defined in claim 6, wherein the surface of the liquid-permeating member has been shaped by pressing a tool onto the surface, the tool having a shape corresponding to at least a part of the noncontacting part.

8. The stamp marker as defined in claim 6, wherein the liquid-permeating member is made of felt.

9. The stamp marker as defined in claim 6, wherein the liquid-permeating member comprises a distal member and a base so as to supply the liquid through the base to the distal member, the distal member having a surface that has the contacting part and the noncontacting part.

10. The stamp marker as defined in claim 6 further comprising a liquid regulator for regulating supply of the liquid, so that the liquid is supplied to the liquid-permeating member via the regulator.

11. The stamp marker as defined in claim 6, the liquid being substantially white.

12. The stamp marker as defined in claim 6, wherein the material of each of the contacting and noncontacting parts is fibrous and the noncontacting part has a higher fiber density than the contacting part.

13. The stamp marker as defined in claim 6, wherein the material of the contacting and noncontacting parts is felt.

14. The stamp marker as defined in claim 6, wherein the liquid-permeating member is made from a material that is compressed by a pressing tool.

15. The stamp marker as defined in claim 6, wherein the contacting part at least partially surrounds the noncontacting part.

16. The stamp marker as defined in claim 6, wherein the contacting part is substantially planar.

17. The stamp marker as defined in claim 6, wherein the contacting part and non-contacting part face axially.

18. The stamp marker as defined in claim 6, wherein the liquid permeating member is made from a material that is compressed axially to define the noncontacting part.

* * * * *